US006721979B1

(12) United States Patent
Vrzalik et al.

(10) Patent No.: US 6,721,979 B1
(45) Date of Patent: Apr. 20, 2004

(54) AIR BED WITH FLUIDIZED BEAD SURFACE AND RELATED METHODS

(75) Inventors: John H. Vrzalik, San Antonio, TX (US); Peter A. Leininger, San Antonio, TX (US); Ronald B. Hicks, San Antonio, TX (US)

(73) Assignee: KCI Licensing, Inc., San Antonio, TX (US)

( * ) Notice: Subject to any disclaimer, the term of this patent is extended or adjusted under 35 U.S.C. 154(b) by 0 days.

(21) Appl. No.: 10/457,660

(22) Filed: Apr. 17, 1997

Related U.S. Application Data

(63) Continuation of application No. 08/714,528, filed on Sep. 16, 1996, now abandoned, which is a continuation of application No. 08/428,689, filed on Apr. 25, 1995, now abandoned.

(51) Int. Cl.[7] ..... A61G 7/057; A47C 21/04; A47C 27/10

(52) U.S. Cl. ..... 5/689; 5/702; 5/912; 5/714

(58) Field of Search ..... 5/689, 652.2, 655.4, 5/702, 714, 726, 423, 911, 912, 914, 939

(56) References Cited

U.S. PATENT DOCUMENTS

| | | | | |
|---|---|---|---|---|
| 3,008,465 A | * | 11/1961 | Gal | 5/455 |
| 3,428,973 A | | 2/1969 | Hargest et al. | |
| 3,866,606 A | * | 2/1975 | Hargest | 5/689 X |
| 4,347,633 A | * | 9/1982 | Gammons et al. | 5/456 |
| 4,371,997 A | * | 2/1983 | Mattson | 5/455 |
| 4,483,029 A | | 11/1984 | Paul | |
| 4,517,693 A | * | 5/1985 | Viesturs | 5/455 |
| 4,637,083 A | | 1/1987 | Goodwin | |
| 4,686,722 A | * | 8/1987 | Swart | 5/914 |
| 4,689,844 A | * | 9/1987 | Alivizatos | 5/911 |
| 4,694,520 A | | 9/1987 | Paul et al. | |
| 4,694,521 A | * | 9/1987 | Tominaga | 5/453 |
| 4,879,777 A | | 11/1989 | Goodwin | |
| 4,951,335 A | * | 8/1990 | Eady | 5/455 |
| 5,008,965 A | * | 4/1991 | Vrzalik | 5/689 |
| 5,109,560 A | * | 5/1992 | Uetake | 5/455 |
| 5,109,561 A | * | 5/1992 | Schild | 5/455 |
| 5,539,943 A | * | 7/1996 | Romano | 5/689 X |
| 5,623,736 A | | 4/1997 | Soltani et al. | |

FOREIGN PATENT DOCUMENTS

| | | | | |
|---|---|---|---|---|
| EP | 0317009 | | 5/1989 | |
| WO | WO 96/33641 A1 | * | 10/1996 | 5/689 |

* cited by examiner

*Primary Examiner*—Robert G. Santos
(74) *Attorney, Agent, or Firm*—Eric W. Cernyar

(57) ABSTRACT

A therapeutic treatment bed with features to enhance the care and comfort of burn patients and others subject to extensive recuperative periods. Among the features are patient engaging fluidized bead surfaces integral with the upper surfaces of air cushions provided by an air bed. Detachable conformation of the fluidized bead surfaces is also provided.

20 Claims, 7 Drawing Sheets

AIR BED WITH FLUIDIZED BEAD SURFACE AND RELATED METHODS

This application is a cont. of Ser. No. 08/714,528 filed Sep. 16, 1996, now abandoned. This a cont. application Ser. No. 08/428,689 filed Apr. 25, 1995, now abandoned.

BACKGROUND OF THE INVENTION

1. Field of the Invention

The present invention relates to therapeutic beds and, more particularly, to therapeutic beds of the type having an air cushion support together with an integral fluidized bead surface.

2. Background

The care of patients requiring extensive recuperative periods presents many extraordinary challenges which have not been adequately addressed in the past. Not the least of these challenges is providing a patient support surface that is both sturdy and easy to use, while simultaneously providing preventive therapy and intervention for the numerous complications associated with extended confinement to bed. Burn victims, for instance, typically require extremely low patient interface pressures, high air flow, as well as low shear forces. It is well-known in the art that two of the most ideal patient support surfaces for the immobile patient are low-air-loss beds and fluidized bead beds. Low-air-loss bed and mattress examples are described in U.S. Pat. Nos. 5,005,240 (KINAIR) and 5,022,110 (FIRSTSTEP). Examples of bead beds are described in U.S. Pat. Nos. 4,564,965 (CLINITRON), 5,008,965 (FLUIDAIR), and 5,036,559 (ELEXIS).

Conventional bead beds typically include a bathtub-like tank filled with medical-grade silicone microspheres (or "beads"). Each individual bead typically has a soda-lime core encased within a silicone sphere approximately 100 microns in diameter. A diffuser board is positioned horizontally at the base of the tank, separating two compartments within the tank—an upper compartment which contains the beads and a smaller, lower compartment which serves as a plenum chamber filled with air for fluidizing the beads. With appropriate blowers and temperature control systems, air is blown into the plenum chamber, from which the pressurized air is forced upwardly through the diffuser board and further (often in bubble-like manner) through the beads, giving the beads a liquid-like quality. A filter sheet is draped over the top of the tank to contain the beads while allowing the upward passage of air. The patient can lie either directly on the filter sheet or on a second cover sheet. Despite the liquefied state of the beads, the patient remains buoyant because of the relative density of the beads.

Although such bead beds may actually provide the most therapeutic surface from the standpoint of pressure and microclimate at the patient interface (i.e., interface between patient and mattress), conventional bead beds have many drawbacks. Traditionally, bead bed manufacturers have thought that a significant depth of beads was required in order to provide an adequate patient support with good fluidization. Fluidizing the resulting volume of beads inherently required heavy-duty blowers and related equipment, not to mention the extra structural requirements for the frames of such beds. Conventional bead beds are extremely heavy (approximately 2,000 pounds), which not only makes them difficult to maneuver, but also requires that they be used only in buildings having extremely sturdy support. Second-story placement in wood-frame houses is typically avoided without assessment by a structural engineer. The poor maneuverability and excessive weight may also present risks to caregivers who are not properly trained in safely maneuvering such heavy objects.

Handling a patient in a conventional bead bed is also plagued with difficulty, largely because caregivers must reach down into the tank and lift the patient up or out for handling. The teaching of U.S. Pat. No. 5,008,965 attempted to address this situation by providing separate air bladders within the bead compartment for displacing the beads upwardly, hence, lifting the patient relative to the tank. Still others, such as illustrated in U.S. Pat. No. 5,036,559 (ELEXIS), have attempted to address the problem by providing deflatable or otherwise collapsible tank walls instead of the traditionally rigid walls. Related difficulty is faced by the patient who is attempting to sit up in such beds. Although foam wedges and the like are often used to help prop up the patient, props present the obvious downfall of interfering with the therapeutic benefits of the bead surface. Using props also renders such products more difficult to manipulate than conventional hospital beds which have automatic bed functions such as head-up, Trendelenberg and the like.

Air beds, on the other hand, eliminate many of these problems. Not only are the mattresses of the air beds lighter due to the lighter supporting medium (i.e., air versus beads), but lighter-duty supportive equipment and structural members are needed as well. Moreover, air beds permit many of the user-friendly features of standard hospital beds, such as sit-up, Trendelenberg, and the like, not to mention retractable side rails and radioluminescence. The extra space beneath the patient surface also allows not only for extra storage, but also for adding accessory therapeutic units such as percussion and hyper-hypothermia treatment.

Many other advantages and disadvantages of low-air-loss beds and air fluidized bead beds will be understood by those of ordinary skill in the art, especially after reviewing this specification.

SUMMARY OF THE INVENTION

It is a fundamental object of the present invention to improve over the prior art, including to provide a therapeutic patient treatment bed and related methods which facilitate the care and comfort of bed-ridden patients, while simultaneously addressing the complications associated with immobility.

This and other objects are addressed by providing a therapeutic patient treatment bed wherein the patient support surface comprises an air cushion with integral fluidized bead surfaces. The beads may be fluidized by the same air flow as is utilized for inflating the patient support air cushion. Unlike many prior bead beds, the invention described herein allows the patient support surface to be positioned as desired, providing a lightweight, full-featured fluidized bead bed. Moreover, because air flow can be compartmentalized into a plurality of air bags or cushions, each with independent bead surfaces, the present invention also enables a wide variety of additional surface therapies not previously available with bead beds, including pulsation, percussion, and kinetic therapies. The fluidized bead surfaces may also be detachable for facilitating infection control procedures.

Many other objects, features, variations and advantages of the invention will be evident from a review of the further descriptions herein, particularly when reviewed by one of ordinary skill in the art with the benefit of the accompany drawings, appended claims and the prior art.

DETAILED DESCRIPTION OF THE PREFERRED EMBODIMENTS

Figure 1:
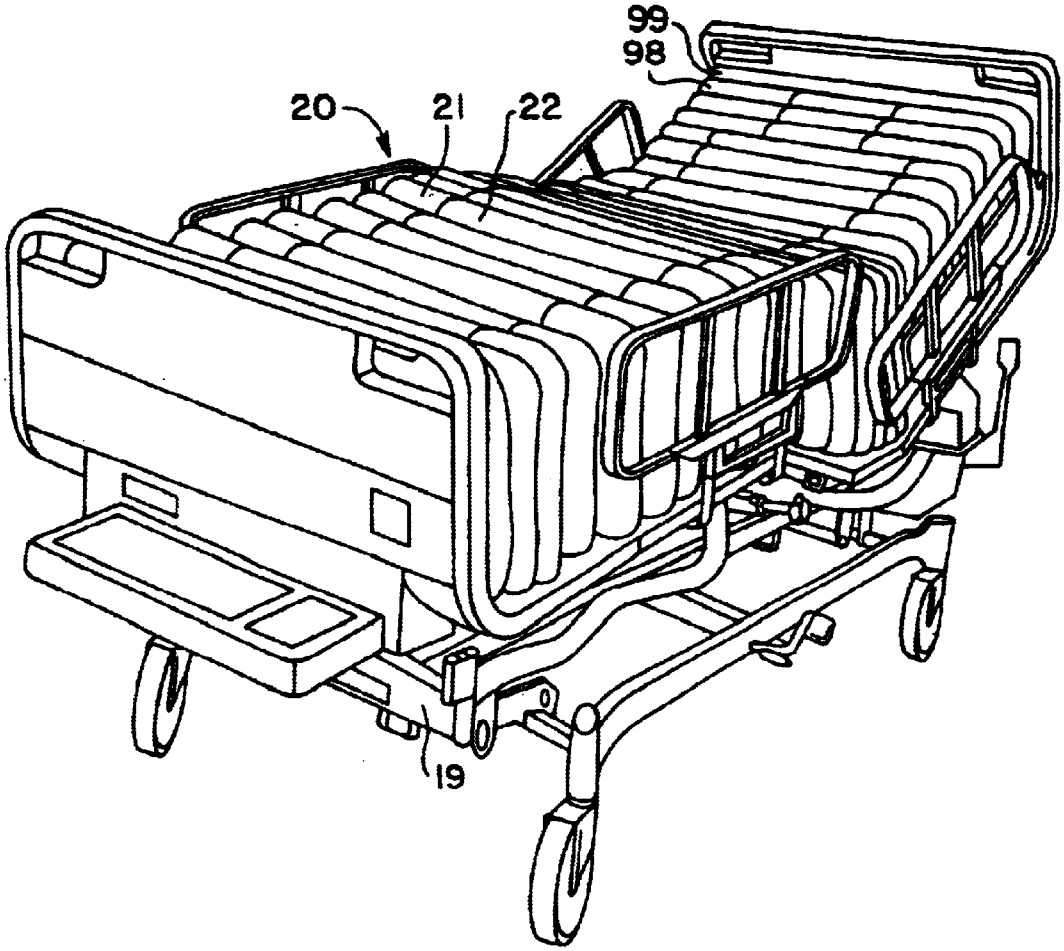
FIG. 1 is a perspective view of a patient treatment bed 20 (absent its cover sheet) configured and operatively inflated for typical use, which comprises a presently preferred embodiment of the present invention.

Although most aspects of the invention described and claimed herein could be embodied in many different types of beds, mattresses and/or cushions, the bed 20 shown in FIG. 1 is considered to be a presently preferred embodiment of that invention. Referring to FIG. 1, there is shown a patient treatment bed 20 that is uniquely suited for treatment of burn patients and other patients subject to extensive recuperative periods. Bed 20 includes a frame 19 supporting a plurality of patient support air bags 21, which are uniquely adapted with bead pouches 22. One fairly basic aspect of the invention can be embodied in one or more cushions such as patient support air bags 21, operatively associated with one or more fluidized bead containment pouches 22 and means for fluidizing the same, all of which may or may not be mounted on a frame such as frame 19.

One advantage of the invention is that it can be implemented as a relatively simple upgrade to a pre-existing air support. Typically, the only change needed will be to replace one or more of the air cushions of the pre-existing support with new cushions that are specially-adapted to implement the present invention. In some cases, however, it may be that additional blower capacity is needed due to the relatively large amount of air required to fluidize the bead pouches 22 as compared to the amount of air that may be needed to sustain inflation of the pre-existing support. Those of skill in the art will understand how to increase blower capacity, such as by adding an additional blower or redirecting existing blowers. The term "host platform" is used in this description to refer to the preexisting support. Modifications to the host platform may be described in detail, whereas unmodified details will be described only to the extent desired for reference.

The host platform 20 may be any of a number of commercially available patient air supports, preferably low-air-loss patient treatment beds. Host platform 20 of the preferred embodiment comprises a low-air-loss bed presently commercialized under the trademark "KINAIR III," commercially available from Kinetic Concepts, Inc. of San,Antonio, Tex. ("KCI"). The KINAIR III bed is described in substantial detail in U.S. Pat. No. 5,005,240, dated Apr. 9, 1991, incorporated herein by this reference. Other suitable host platforms include, but are not limited to, those marketed by KCI under the trademarks "HOMEKAIR," "THERAPULSE" and "BIODYNE II." All of these platforms are commercially available from Kinetic Concepts, Inc. The THERAPULSE bed is described in substantial detail in U.S. Pat. No. 5,044,029, dated Sept. 3, 1991, incorporated herein by this reference. The BIODYNE II bed is described in substantial detail in U.S. Pat. No. 5,142,719, dated Sep. 1, 1992, also incorporated herein by this reference. Other host platforms might include wheelchairs with therapeutic air cushions or stand-alone therapeutic air mattresses mounted on any desired support.

As suggested above, the principal difference between bed 20 and a commercially available KINAIR III bed is the adaptation of its air bags 21 to include fluidizable bead pouches 22. A simple form of such an adapted air bag 21 can be made by cutting a rectangular hole in the upper surface of an existing KINAIR III air bag and sewing a similarly-shaped, air-permeable bead pouch 22 over the hole. An air bag 21 made in such manner is shown in FIGS. 2A&B, as part of a presently preferred embodiment of the invention. Conventional stitching techniques can be used to provide a smooth outer surface for the adapted bag 21. For instance, although it is stated to sew the bead pouch "over" the hole, it will be understood by those of skill in the art that an acceptable technique for minimizing exposed edges would be to sew (or otherwise attach) the pouch from the inside of air bag 21, around the perimeter of the rectangular hole 39 in the air bag's upper surface 27. Conventional seam-sealing techniques can also be used to minimize loss of air through the seams 40*a*–40*d*, as well as any other seams in bag 21, to minimize any unnecessary air leaks in the air bag 21. Such a construction enables the air bag 21 enclosure to serve as an effective plenum chamber for fluidizing the beads within the bead pouch 22; the space 48 enclosed by air bag 21 is, hence, referred to as the "plenum space" 48.

Referring to FIGS. 2A&B, each adapted air bag 21 includes bead pouch 22 formed integrally therein. Such integral construction ensures simplicity of manufacture and use, while minimizing any excessive loss of air, as might be more likely with a two-part construction. The air bag 21 can be disinfected through laundering with a dilute bleach solution in the same manner as conventional air bags. Due to the inclusion of the bead pouch 22, adequate drying of the air bag 21 may require operative connection of the air bag 21 to a host platform. Such operative connection helps dry the beads by virtue of the air blowing through beads 200. Although the exact length of time needed to dry the beads 200 may vary, twenty-four hours will generally be more than adequate. The drying time should be however long it takes to dry the beads so they can be adequately fluidized, while also respecting any infection control concerns.

Figures 3A, 3B:
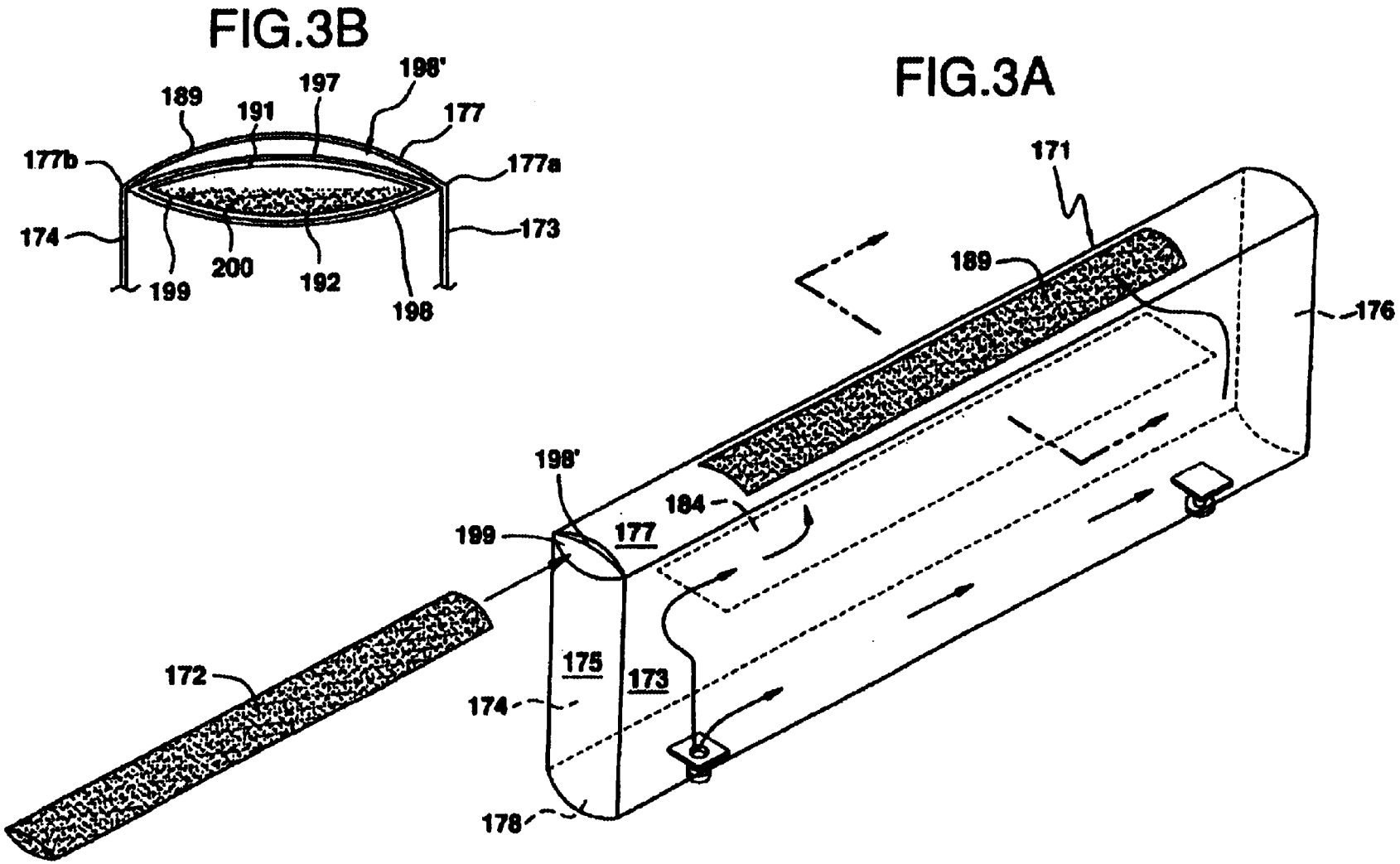
FIG. 3A is a partially-exploded perspective view of an air bag 171, which is an alternate embodiment of the air bag 21 shown in FIGS. 2A–B.
FIG. 3B is a partial cross-sectional view of the air bag 171 shown in FIG. 3A, including its fluidized bead pouch 172, taken along lines 3B—3B in FIG. 3A.

One alternative embodiment of air bag 21 is described further herein as air bag 171, with reference to FIGS. 3A&B. Such alternative air bag 171 utilizes a bead pouch 172 that is adapted to be removed from a pocket 198' in the end wall 175 of the air bag 171. The pouch 172, therefore, can be removed and disinfected or disposed of separate from any low-air-loss components. Another alternative embodiment of air bag 21 is described further herein as air bag 121, with reference to FIGS. 4A–D. Such alternative air bag 121 also utilizes a two-part construction for its bead pouch 122. Air bag 121 is different, though, in that its bead pouch 122 is embodied in a removable cap 130 for air bag 121. In such alternative, the bead containment pouch 122 is removed from the air bag 121 by removing the cap 130 as a whole, so that the pouch 122 can then be disinfected or disposed of separate from any low-air-loss components. Other embodiments are also disclosed.

Each of the air bag embodiments 21, 171, 121 and 121' are made from the same basic fabrics—a low-air-loss material and a filter sheet material. The low-air-loss material in the preferred embodiment is a polymer-coated nylon material commercially available under the trademark "GORE-TEX" from W. L. Gore & Associates, Inc. of Elkton, Md. Such low-air-loss material has very little air permeability yet has a moisture vapor transmission rate in excess of 4700 $g/m^2$/24 hours. In the preferred embodiment, the filter sheet fabric is constructed of 63-micron monofilament polyester fiber thread with 40-micron nominal mesh opening and 15% open area. The filter fabric is commercially available from Tetko, Inc. of Briarcliff Manor, N.Y. One possible alternative that might be considered is to use a similar multifilament fabric rather than the monofilament. Other suitable alternatives will be evident to those of skill in the art.

Regarding the construction of the air bag embodiments 21, 171, 121 and 121', there are several common elements. Although most of such common elements are also common with the commercially-available KINAIR III air bags, brief reference is made to each of such common elements (referring to reference numerals used in FIG. 2A). Air bag 21, to begin with, is formed to have the general shape (when inflated) of a rectangular prism, as shown in FIG. 2A. Air sac 21 has six generally rectangular walls 23–28, which may be considered as three pairs of opposed similar walls: opposite side walls 23 and 24, opposite end walls 25 and 26, and opposite top and bottom walls 27 and 28. Each of such walls 23–28 is formed primarily of the low-air-loss material referenced above, cut in pieces that are stitched (or otherwise joined) to adjacent pieces along their adjoining edges. As will be understood by those of ordinary skill in the art, particularly with reference to a commercially-available KINAIR III air bag, certain walls may actually be formed from the same piece of material as another wall, while other walls may be formed of a combination of one or more pieces of material. The edges between two adjoining walls, hence, may not in actuality constitute seams between fabric pieces. The sheet of material which forms the top wall 27, for instance, actually extends beyond each of its edges 27*a*–27*d* shown in FIG. 2A. Fabric-gathering seams and conventional stitching techniques are used to generally form each of the four corners 27*e*–27*h* of upper wall 27. That same piece of fabric which forms upper wall 27, further, extends partially down each of the opposite side walls 23 and 24 and each of the opposite end walls 25 and 26 to a seam (not shown) with an adjoining piece of fabric slightly above the level of baffle 127. Again, such sewing techniques and the general construction for the various walls 23–28 of air sac 21 will be evident to those of ordinary skill in the art, particularly with reference to commercially-available air sacs. It is also noted that in certain alternative embodiments it may be desired to form the air cushions in different shapes, such as the cut-out shape of the BIODYNE air sacs, or the relatively flat (or "low profile") shape of the air sacs used in products such as the DYNAPULSE product, also available through Kinetic Concepts, Inc.

Still referring to common elements of the air bag embodiments 21, 171, 121 and 121', as well as the KINAIR III air bags, each air bag 21, 171, 121 and 121' also has a post 43 and an air inlet 44 operatively secured to the bottom wall 28 thereof, as is standard for KINAIR III air bags, for attachment to the host platform 20. Such hardware 43 and 44 are standardly employed in a manner which allows entry of air into a space 48 enclosed by the main part 29 of air bag 21, such air being blown by blowers such as standardly included in the host platform 20. Each air bag 21 further comprises a baffle 34 also constructed of low-air-loss fabric, although less costly alternative fabrics may be desired as air permeability and low skin shear benefits are not necessary for baffle 127. Baffle 127 functions to ensure the desired prismatic shape of the inflated bag 21 (i.e., that of a rectangular prism). The baffle 127 is sewn, or attached by other equivalent means, at its edge 35 to the inside surface of the front side wall 23 of the air bag 21. The baffle 127 is similarly sewn, or attached by other equivalent means, at its edge 36 to the inside surface of the rear side wall 24 of the air bag 21. The end-to-end length of baffle 127 as measured from edge 37 to edge 38 is sufficiently less than the end-to-end length of air bag 21, as measured from end 25 to end 26. That shorter length allows substantial air flow around the baffle. Said air flow is as depicted by arrows (including arrows 33*a*–*c* in FIGS. 2A&B). The preferred embodiment provides a minimum 4-inch opening between end wall 25 and edge 37 as well as end wall 26 and edge 38.

Further understanding of the hardware 43–44 and sewing techniques utilized in the preferred embodiment may be gathered to some extent with reference to U.S. Pat. No. 5,062,171, dated Nov. 5, 1991, incorporated herein in its entirety by this reference.

Figure 2B:
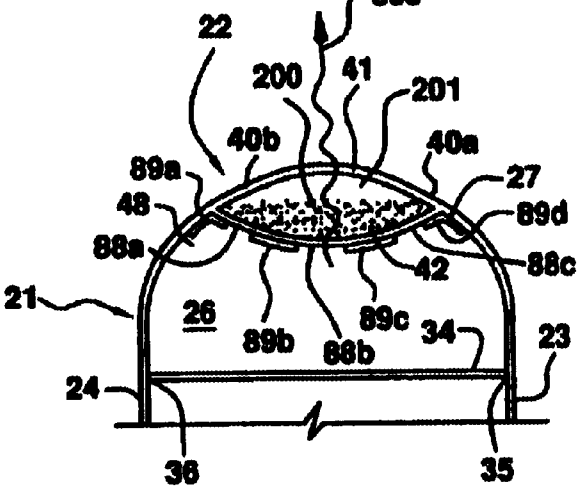
FIG. 2B is a partial cross-sectional view of the airbag 21 shown in FIG. 2A.
Figure 2A:
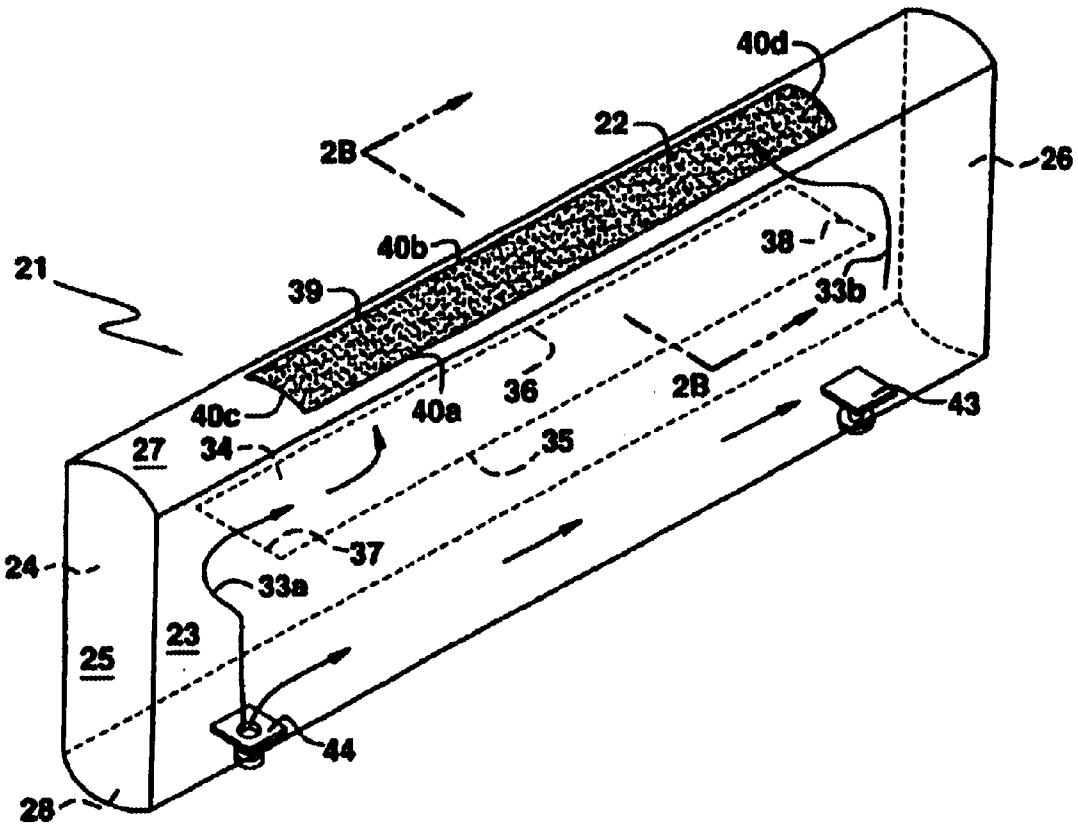
FIG. 2A is a perspective view of an air bag 21 of the bed 20 shown in FIG. 1.

Referring to FIG. 2B, there is shown a sectional view of a fluidized bead containment pouch 22 (viewed on the vertical plane 2B—2B indicated in FIG. 2A). The bead containment pouch 22 is substantially rectangular from above (rectangular shape generally visible in FIG. 2A) and comprises rectangular top and bottom filter sheets 41–42. Unless sheets 41 and 42 can be readily made together as a seamless pouch, sheets 41 and 42 are sewn or otherwise joined to each other around their perimeters (i.e., along edges 40*a*–40*d*) in a substantially sealed manner so as to form a substantially closed pouch for containing beads 200. In the preferred embodiment, filter sheets 41 and 42 are constructed of the same filter sheet fabric as described previously herein. By making pouch 22 seamless or by providing sealed seams 40*a*–*d*, leakage of beads 200 from pouch 22 can be minimized. Once filled with beads 200 to the desired extent and sealed closed, the pouch 22 is then sewn (or otherwise attached) to the upper wall 27 of air bag 21, around the perimeter of hole 39.

Figure 7A:
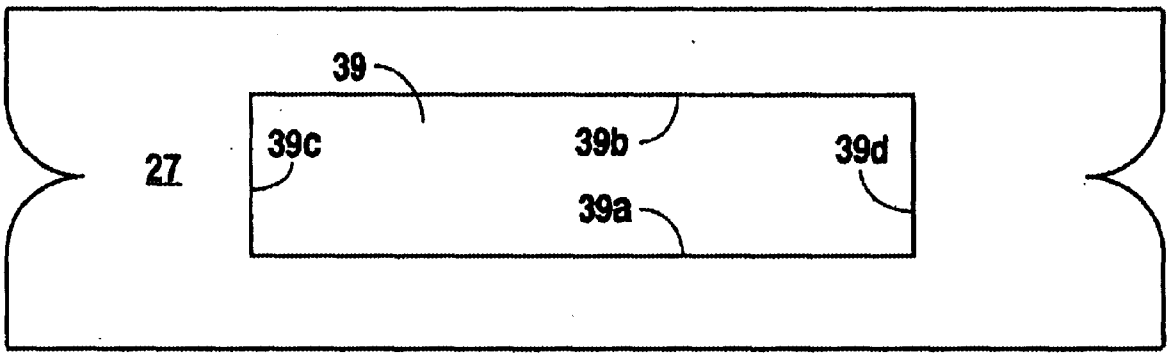
FIGS. 7A and 7B are views of the unassembled upper wall 27 and filter sheets 41 and 42 of bead pouch 22.
Figure 7B:
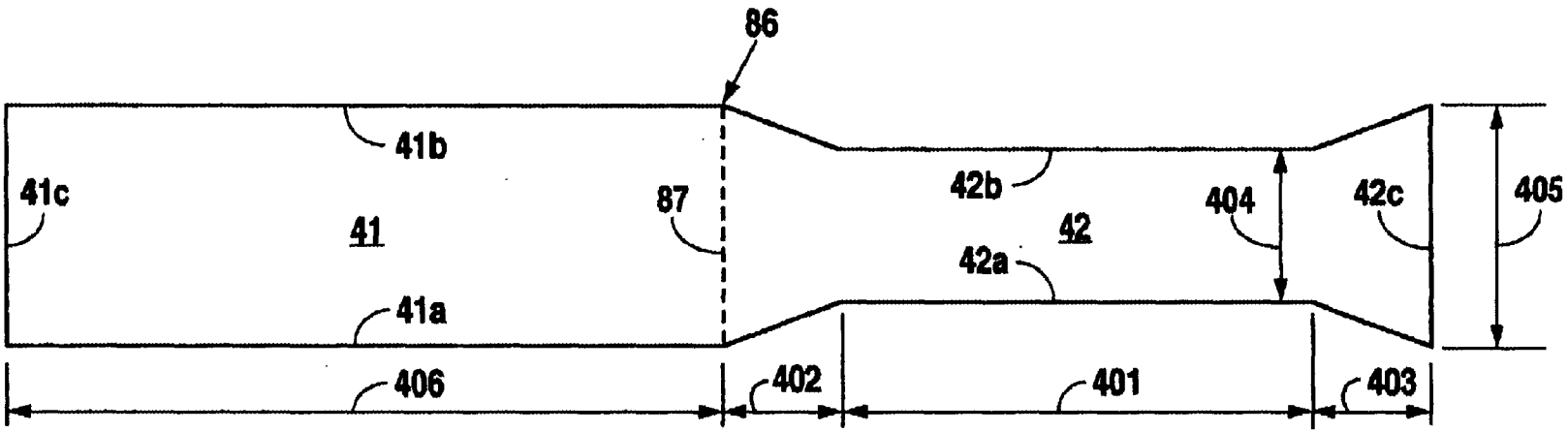

The preferred size of upper and lower filter sheets 41 and 42 (and, hence, pouch 22) will be best understood from the description of the preferred method for making pouch 22. With reference to FIGS. 7A & 7B, there is shown a plan view of the cut-outs for the upper wall 27 and bead pouch 22, respectively. As mentioned, the rectangular hole 39, which is cut out of upper wall 27, is a substantially rectangular hole. The preferred dimensions of such hole are 5 inches (along edges 39*c*&*d* of hole 39) by 23 inches (along edges 39*a*&*b* of hole 39). The pouch 22 begins at a single piece 86 of filter sheet fabric cut in the shape as shown in FIG. 7B. The overall dimensions of piece 86 are nominally 49 inches (in length) by 6½ inches (in width), although lower sheet 42 is tapered in its primary dimension to 4 inches. The dimensions 401–406 of piece 86 are 15½, 4½, 4½, 4, 6½ and 24½ inches, respectively. Once piece 86 is cut as shown in FIG. 7B, the piece is folded al center line 87 and edges 41*a*&*b* are sewn (inside out) and sealed to edges 42*a*&*b* to give pouch 22 its basic shape. Then, the assembly is pulled right side out and filled with beads 200 (not shown in FIG. 7B) through an opening formed between edges 41*c* and 42*c*, after which the same edges 41c and 42*c* are sewn and sealed. The seams formed by the unions of edges 41*a–c* and 42*a–c*, and a final edge formed by the fold 87, are then sewn and sealed to upper wall 27 along the perimeters of hole 39. The result produces a bead pouch 22 that is slightly tapered along its midsections. Given the amount of material used by seams (approximately ¼ inch for each seam), the final width of lower filter sheet 42 which is exposed to the beads 200 is approximately 3 inches at its narrowest point and 5 inches at its longitudinal ends adjacent to seams 40*c*&*d*. The remaining dimensions of FIGS. 7A&B are as shown therein.

The resulting size is generally such that in every air bag 21 on bed 20 included a pouch 22, then the entire patient could be supported on the bead pouches 22. Certain ones of air bags 21 may have differently sized pouches 22, or may not have pouches at all. In the bed 20 illustrated in FIG. 1, for instance, head air bags 98 have shorter pouches (only about 10 inches long), and the last air bag 99 does not have a pouch 22 at all. Further, air bags with and without pouches 22 can be mixed and matched along the length of the bed 20 to achieve a desired surface. For patients with local bums, for instance, the fluidized bead surface may be limited to that region of the patient where the bum is located, while the rest of the patient is supported on conventional KinAir III air bags. In other cases, the bead surface may be limited to the seat section as that is where weight concentration is greatest. In any case where pouches 22 are included in a given air bag 21, however, the upper sheet 41 is preferably about 2 inches wider than the lower sheet 42, for reasons mentioned elsewhere herein.

The beads 200 contained in each bead pouch 22 are preferably medical grade microspheres of the type commonly employed in air fluidized bead beds. Such beads range in size from 50 to 150 microns in diameter and are commercially available from a number of sources, including Potters Industries, Inc. of Carlstadt, N.J. A single bead pouch 22 preferably contains about a two pounds of beads, although quantities of bead material from ¼ to 30 pounds or more per air bag may be suitable. The bead pouch 22 is also not completely filled, so that the beads are free to fluidize therein. Consequently, when air flows through bead pouch 22 without a patient supported thereon, the upper filter sheet 42 tends to billow upwardly, forming an air space 201 above the beads 200.

The pouch 22, hence, is integrated with air bag 21 in a manner that encourages air flow from space 48, through pouch 22, tending to fluidize any quantity of beads 200 within pouch 22. Because the low-air-loss GORE-TEX fabric has very low air permeability, the air that inflates the air bag 21 tends to flow, more particularly, from plenum 48, through the lower filter sheet 42, through the beads 200 and excess space 201, and on through the top filter sheet 41, as suggested by arrow 33*c*. By using the same air for bead fluidization as is used to inflate the air bag 21, greater fluidization is achieved in those pressure zones in which air bags are inflated to higher pressures, which usually occurs with those air bag zones supporting heavier body portions (such as a patient's seat section). Hence greater fluidization is provided where it tends to be needed most—beneath the locations where the interface pressures are also greatest.

It is also noted, however, that lower filter sheet 42 may require some degree of air flow restriction in order to prevent excessive loss of air from within air bag 21. The balance of the amount of air flow that will be desired through lower filter sheet 42 will depend on a variety of circumstances, including the blower capacity of the host platform 20, the volume of beads 200 in each air bag 21, and the number of air bags 21 which are adapted with bead pouches 22. In one preferred embodiment, it has been found that air-impermeable strips 89*a*&*b* may be adhered to the outer surface of lower filter sheet 42 to reduce and concentrate air flow through lower filter sheet 42. Such strips 89*a*&*b* are preferably composed of commercially available sealing tape such as is used for waterproofing grommets in the clothing industry. Suitable sealing tape is a ¾-inch Teflon sealing tape commercially available through the W. L. Gore Company. Strips 89*a*&*b* (and similar strips sealing seams 40*a*&*b*) preferably around the entire length of bead containment pouch 22 on the lower surface of lower filter sheet 42. Such configuration of sealing strips 89*a–d* leaves three sections 88*a–c* of lower filter sheet 42 unobstructed for free flow of fluidizing air therethrough. Due to the 3-inch width of lower filter sheet 42, sections 88*a–c* end up being three strips of unobstructed filter sheet running the length of bead containment pouch 22. Each of strips corresponding to sections 88*a–c* are approximately ¼-inch wide, although that width dimension will flare toward the ends 40*c* and 40*d* of bead containment pouch 22 as the bead containment pouch itself flares as well.

It is noted that once the air has passed through pouch 22, its direction of flow is determined based on other factors. For instance, if a conventional, high-air-loss cover sheet is used, some of the fluidizing air will pass through the cover sheet while the remainder will be diverted to the sides of the bed 20 by that cover sheet. If a cover sheet is not used, then more of the fluidizing air would tend to rise upwardly around the patient's body.

Figures 4A, 4B, 4C, 4D:
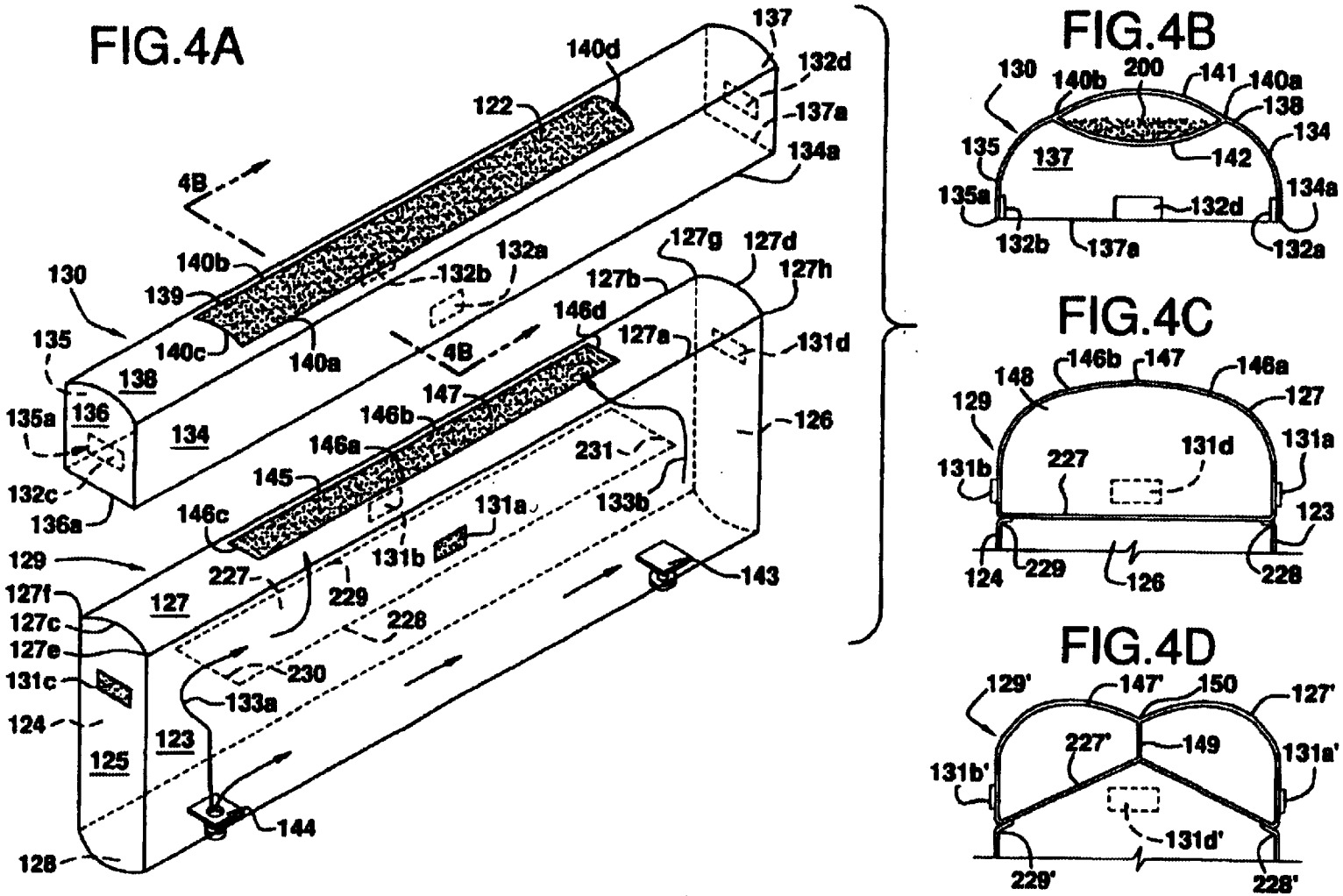
FIG. 4A is a partially-exploded perspective view of an air bag 121, which is a second alternative of the air bag 21 shown in FIGS. 2A–2B.
FIG. 4B is a cross-sectional view of the airbag cap 130 as shown in FIG. 4A.
FIG. 4C is a partial cross-sectional view of the main part 129 of the air bag 121 shown in FIG. 4A.
FIG. 4D is a partial cross-sectional view of an alternative embodiment 129' of the main part 129 shown in FIG. 4C, from the same perspective as shown in FIG. 4C.

It is also noted that the profile shape of the pouch 22 (i.e., the cross-sectional shape such as shown in FIG. 2B) depends on a variety of factors. Such factors include but are not limited to the size of the bead pouch 22, the relative porosity of the filter sheets 41 and 42, the air pressure within plenum space 48, the quantity of beads 200 within pouch 22, and the patient weight. In many cases, the bead pouch 22 tends to arch upwardly due to the pressure within air bag 21, in contrast to the cigar-like shape shown in FIG. 2B. Two practical concerns with this occurrence are (i) that the beads 200 might migrate downward at the sides of the pouch 22 due to gravity, and (ii) that the arching might restrict free fluidization by compressing the beads between the upper and lower filter sheets 41 & 42. One contemplated way of reducing such concerns is the inclusion of a vertical baffle (not shown) spanning between the lower filter sheet 41 and the horizontal baffle 34, in the same general manner as illustrated in FIG. 4D. Another technique that is preferred is to make the upper filter sheet 41 wider and longer than the lower sheet 42 (approximately 2 inches in each dimension) so that the lower sheet 42 tends to be more taut (and, hence, less arched) than the upper sheet 41. Yet another technique is to increase the volume of the beads 200 in a given air bag 21, such as by starting the bead pouch 22 at the level of baffle 34, with beads filling up roughly the entire upper third of the air bag 21.

Although simple, the construction of air bag 21 might be found to be less than ideal for disinfecting on a routine basis, Referring to FIGS. 3A–4D, alternate embodiments of air bag 21 are shown which allow detachment of bead pouch 22 (or its equivalent) so that the bead containment pouch may be disinfected separately.

The first of such alternatives is shown in FIGS. 3A&B as air bag 171. Air bag 171 is adapted with a removable bead pouch 172. The removable pouch 172 consists only of its upper and lower filter sheets 191 and 192 and the beads 200 contained therebetween. Rather than being permanently sewn to air bag 171, pouch 172 is inserted within (and removable from) a pocket 198' near the upper wall 177 of air bag 171. Access to the pocket 198' is provided through an opening 199 in the end wall 175 of the air bag 171. For minimizing loss of air pressure through opening 199, the opening 199 may be covered and/or sealable by a Velcro flap (not shown) or the like. The pocket 198' is formed of two layers of filter sheet material 197 and 198 just beneath the upper wall 177 of the air bag 171. Layers 197 and 198 are joined by conventional techniques along the opposite edges 177*a* and 177*b* of upper wall 177 to form pocket 198'. The upper wall 177 is also provided with a rectangular filter sheet panel 189 for allowing free flow of air through bead pouch 172. An alternative of air bag 171 excludes the upper filter sheet layer 197 of pocket 198'.

With such construction, the pouch 172 can be removed and disinfected or disposed of separate from the low-air-loss components of air bag 171. Such low-air-loss components can then be disinfected using standard laundering techniques for air bags. The bead containment pouch 172 may be disinfected by infection control techniques which are standard and well-known in the art for fluidized bead systems. Such infection control procedure may involve destroying the filter sheet layers 191 and 192 of the pouch 172 and pouring the beads 200 through a sieve screen into a conventional decontamination tank. Decontamination can then be achieved by a thermal process of heating the beads to 122° F. for at least 24 hours. Further benefits of such removable conformation of bead pouch 172 will be apparent to those of skill in the art.

A second basic type of alternative to air bag 21 is shown in FIGS. 4A–C as air bag 121. Like air bag 171, air bag 121 also has a two-part construction adapted with a removable bead pouch 122 to facilitate infection control. The removable pouch 122, however, is embodied in a removable cap 130 that fits over the top of a main part 129 of air bag 121. The main part 129 can be disinfected through laundering in the same manner as with conventional air bags, and the cap 130 can be disinfected separately. Although the particular technique used for disinfecting the cap should be chosen based on the effectiveness of each technique, it is presently thought that adequate disinfection may be achieved by placing the entire cap 130 into a conventional microsphere decontamination unit, together with a separate bead lot. Such a decontamination is intended to raise the temperature of the cap above 120° F. for more than a 24-hour period. Other disinfection techniques, such as chlorination, gamma radiation and/or autoclaving, may be considered as additional alternatives.

The main part 129 of air bag 121 is much like the construction of a standard KinAir III air bag, except that the main part 129 includes a filter sheet panel 147 and Velcro tabs 131*a–d*. Cap 130 includes the bead containment pouch 122 and Velcro tabs 132*a–d*. The shape and construction of cap 130 is such that it fits snugly over the main part 129 when the main part 129 is inflated, with tabs 132*a–d* positioned to mate with tabs 131*a–d* for releasably securing the cap 130 in place. Once so positioned, cap 130 positions bead pouch 122 over the filter sheet panel 147, so that air escaping through panel 147 is directed through pouch 122, tending to fluidize the beads 200 therein. To optimize fluidization, Velcro tabs 132*a–d* and 131*a–d* may be enlarged or replaced with other connections providing a better seal. Improving such seal ensures that the only significant escape for air from the air bag 121 is through bead pouch 122. The size of the panels 147 and pouch 122 is much the same as that of the pouch 22 in the first embodiment, although panel 145 is preferably narrower than pouch 122.

With reference to FIG. 4D, an alternative construction of main part 129 is shown, designated as 129'. Particularly, main part 129' includes a vertical baffle 149 coextensive with the conventional horizontal baffle 227'. Vertical baffle 149 spans is joined by stitching between the centerline 150 of panel 147' to form a trough-like crease along the top of main part 129'. Such trough-like crease not only tends to bias beads 200 toward the centerline 150, but its stitched joinder increases fluidization (by introducing stitch holes in panel 147') along the centerline 150 where the beads 200 are drawn.

Figure 5:
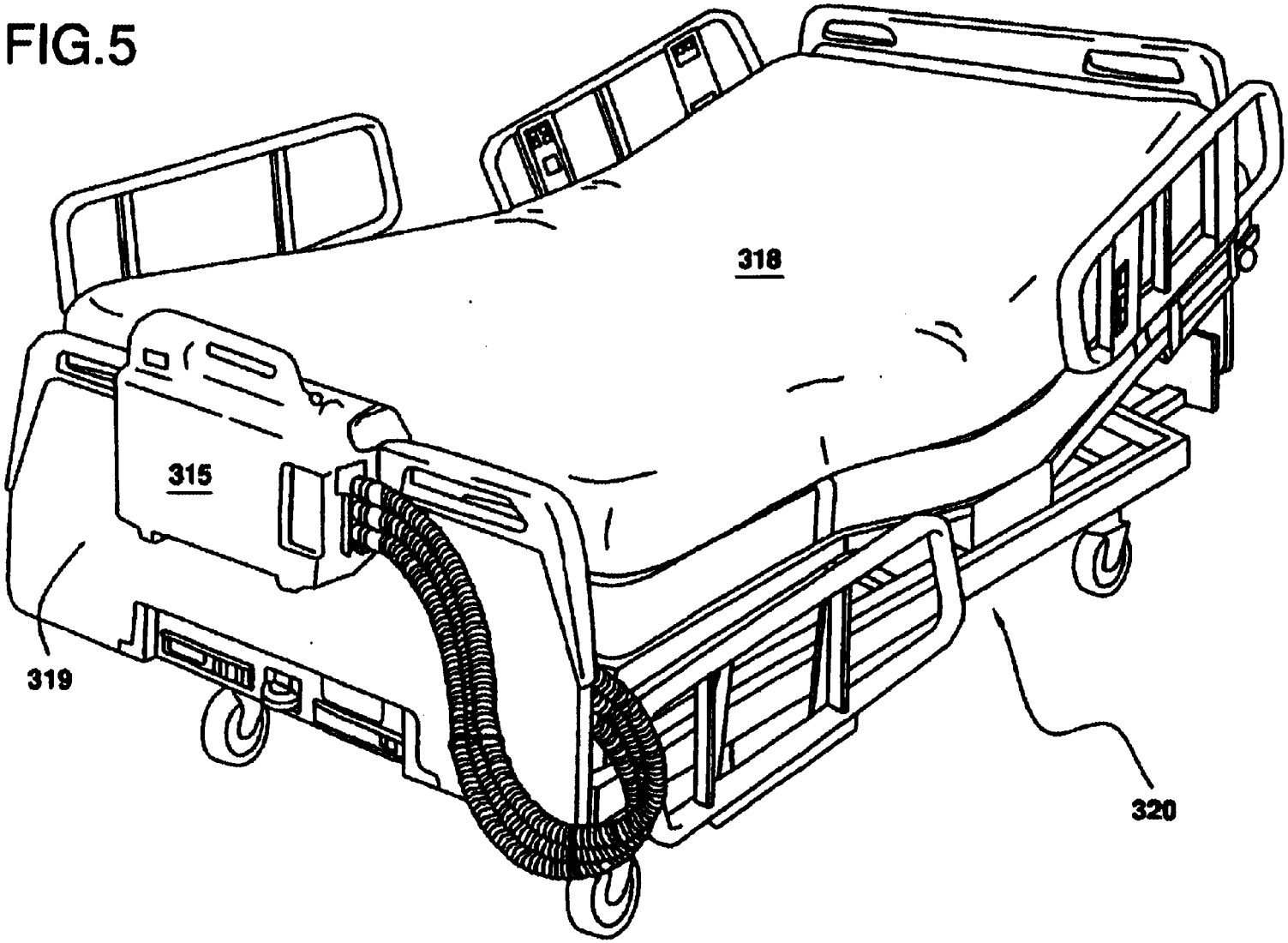
FIG. 5 is a perspective view of an alternate embodiment 320 of the invention.
Figure 6:
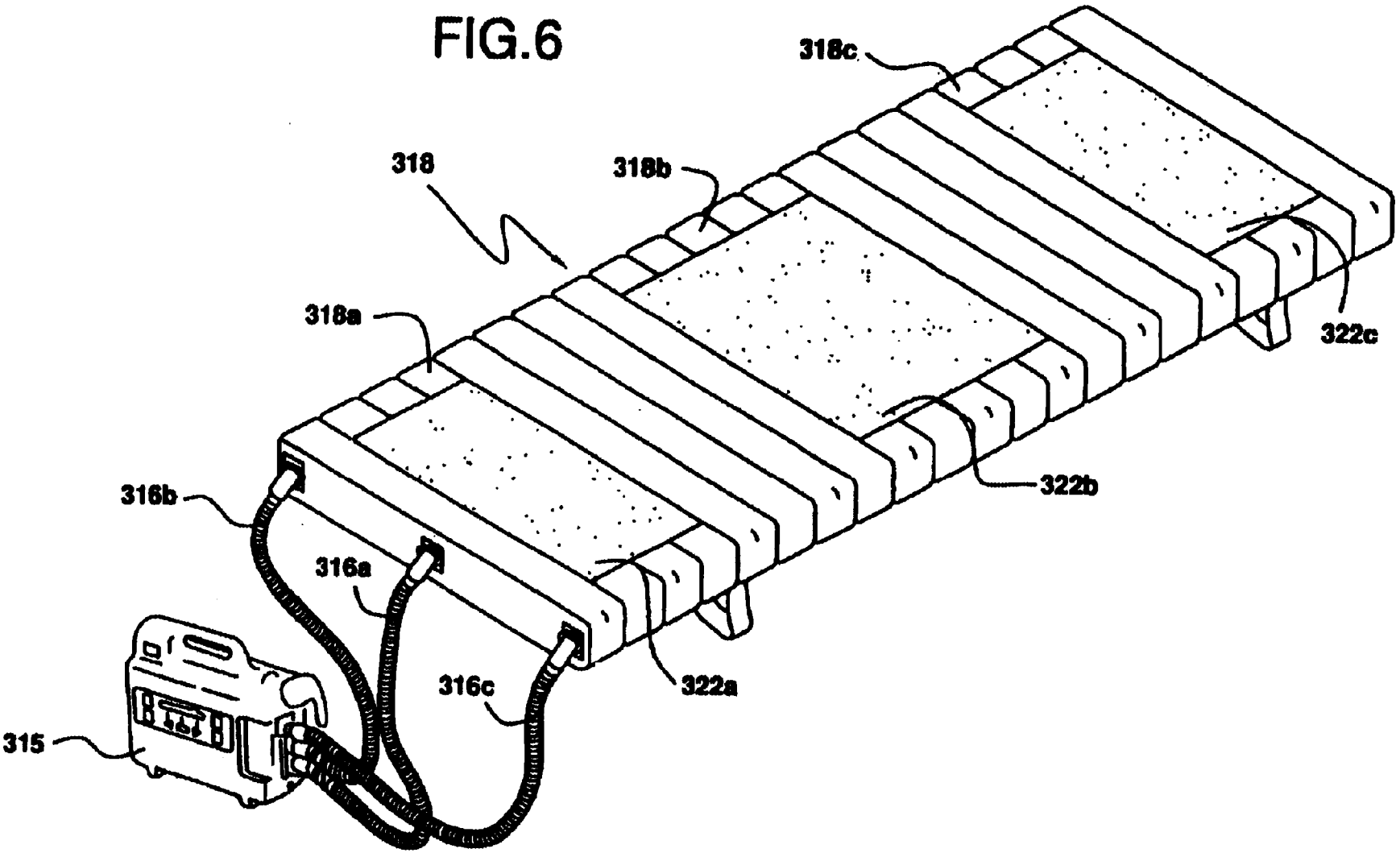
FIG. 6 is a more detailed perspective view of the mattress 320 of the alternate embodiment shown in FIG. 5, absent its frame 319 and cover sheet 380.

Referring to FIGS. 5 & 6, there is shown an alternate embodiment 320 of the bed 20 shown in FIGS. 1–2B. Bed 320 generally consists of an air mattress 318 (and related components) mounted on a standard bed frame 319. The mattress 318 is sectioned into three basic support cushions 318*a*, 318*b*, and 318*c*, as is standard for a variety of mattress and mattress overlay products. Each basic support cushion 318*a, b* or *c* is supplied with air flow from a standard air supply unit 315 through corresponding supply hoses 316*a–c*. Each cushion includes a series of six vertical baffles (not numbered) to ensure retention of a relatively flat shape. Examples of such patient support mattress systems are found in the commercially available FIRSTSTEP SELECT, HOMEKAIR DMS and DYNAPULSE products, each commercially available through Kinetic Concepts, Inc. The particular system illustrated in FIGS. 5&6 is a modified FIRSTSTEP SELECT unit. As with the previously-described embodiments, the mattress 318 is substantially the same as the commercial version of that product. The only significant difference being the addition of fluidizable bead containment pouches 322*a–c* and any additional blowers that might be needed (if any) to fluidize the same. As will be evident to those of skill in the art, the size of the bead containment pouches 322*a–c* can be varied as desired. For instance, in FIG. 6, it is shown that the size of the pouch 322*b* positioned for supporting the seat section of a patient is larger than the other two pouches 322*a*&*c*. Thus, greater therapy can be provided in the seat section (or in any other areas) where the therapeutic need is greater. The particular method of adapting the cushions 321*a–c* with an appropriate number of bead containment pouches 22 is not critical but will be understood from an understanding of the preferred embodiment of air bag 21. Another variation (not shown) of bed 320 can be made by replacing substantially all of the top surface of the mattress 318 with a single fluidizable bead pouch.

The invention described herein allows combination of a fluidized bead patient support surface, well-known in the art to be an ideal patient support surface, with the advantages of low-air-loss beds. Such advantages will be evident to those skilled in the art and include, but are not limited to, vertical and/or articulated displacement of the patient support surface, side to side rotation of the patient, automatic percussion of the patient's chest area, and built-in scales, all of which are well-known in the art and may be described in the literature available for the commercial products KFNAIR III, HOMEKAIR, THERAPULSE and BIODYNE II.

Unique advantages afforded by each of the many possible host platforms 20 for implementation of the invention described herein will also be apparent to those skilled in the art. Said advantages will generally vary with the basic capabilities of the chosen host platform 20. One of the more interesting has been found by using air bags like air bag 21 to replace the air bags of a THERAPULSE bed, commercially available through Kinetic Concepts, Inc. Utilization of the THERAPULSE bed as host platform 20 allows the caregiver to establish various pressures within air bags 21 corresponding to differing regions of the patient's body, and also allows automatic pulsation of bead fluidization. A caregiver can, thus, vary the level of fluidization for different parts of the body, and also pulse that fluidization as well. Although the air bags 21 as a whole generally become softer at lower pressures, the beads 200 generally become more stiff with lower degrees of fluidization. Hence, pulsing the fluidization with the THERAPULSE as host platform 20 will cause the beads 200 in the air bags 21 to vary from soft, to stiff, to soft, and so on. Not only will adjacent air bags 21 vary in opposite phase (as is normal for THERAPULSE pulsation), but stiffness of the bead pouch 22 surface will vary in opposition to the air pressure in the air bag 21 as a whole.

Another alternative embodiment, which is not shown in the drawings, is adapted to provide a dedicated air flow for purposes of fluidizing the beads 200 in each air bag 21. The concept for this alternative is to allow separate control of the air supply directed to the plenum used for fluidizing the bead pouch 22 and to reduce the size of that plenum chamber. With a smaller, separately controlled plenum, the pressure of the air fluidizing the beads can be increased to achieve greater fluidization without increasing the pressure of the air bag 21 as a whole. To do this, a separate inflatable chamber is defined within air bag 21 directly adjacent the bead pouch 22. The inflatable chamber serves as the plenum for fluidizing the bead pouch 22, and a separate air supply is directed to that plenum. The construction of the separate plenum within the air bag 21 would be designed in any manner desired, although the simplest approach uses the same low-air-loss material as the remainder of air bag 21. The separate dedicated air flow might be directed through a separate air inlet for the air bag 21. A collapsible air conduit within air bag 21 would also serve to direct the flow of air from the second air inlet to the dedicated plenum. Although conventional air conduit may be suitable, a fabric conduit (also formed of sealed low-air-loss material) may be adequate to serve this purpose. By providing a separate air flow dedicated to fluidization, the inflation of the air bag 21 as a whole could, thus, be varied independently from the fluidization of the bead pouch 22. Similar adaptations of the other alternative embodiments could also be made.

Many other alternatives, variations and modifications of the present invention will be evident to those of skill in the art and are contemplated to fall within the scope of the present invention. Although the present invention has been described in terms of the foregoing preferred and alternate embodiments, this description has been provided by way of explanation only and is not to be construed as a limitation of the invention, the scope of which is limited only by the following claims and any amendments thereto.

What is claimed is:

1. A therapeutic patient treatment bed having an inflatable patient support, wherein said inflatable patient support comprises:

an inflatable air cushion having an upper surface;

said air cushion having an air inlet for enabling adequate air pressure within said cushion for inflation thereof; and fluidizable solid medium associated with the upper surface of said air cushion, wherein inflation of the air cushion is operable to fluidize the fluidizable solid medium so as to enable deformation of said patient support.

2. The patient treatment bed as set forth in claim 1 wherein the fluidizable solid medium is contained by an air-permeable pouch positioned on the upper surface of said air cushion.

3. The patient treatment bed as set forth in claim 2 wherein said air cushion includes an inflatable chamber and said pouch comprises a layer of air-permeable fabric positioned between said inflated chamber and a quantity of the fluidizable solid medium.

4. The patient treatment bed as set forth in claim 2 wherein said pouch is removably secured to the upper surface of said air cushion.

5. A therapeutic patient treatment bed comprising:

a plurality of inflatable air cushions collectively forming an inflatable patient support, at least one of said inflatable air cushions including a chamber and comprising an air-permeable layer positioned between said chamber and a quantity of fluidizable microspheres, such that air within said chamber is directed through said air-permeable layer in a manner which tends to fluidize said microspheres so as to enable deformation of said patient support.

6. The therapeutic bed of claim 5, wherein:

said inflatable air cushion includes an inflatable chamber defined by two types of material, including an air-permeable fabric and a relatively impermeable second fabric, wherein said air-permeable layer is comprised of said air-permeable fabric.

7. The patient treatment bed as set forth in claim 6 wherein a second one of said inflatable air cushions defines a second inflatable chamber and also comprises a layer of air-permeable fabric positioned between said inflatable chamber and a quantity of fluidizable microspheres such that air inflating said second chamber is directed through the associated permeable fabric in a manner which tends to fluidize the second quantity of fluidizable microspheres.

8. The patient treatment bed as set forth in claim 6 wherein an air supply for inflating the second inflatable chamber is controllable separate from the air supply for inflating the first inflatable chamber, thereby enabling a flow of fluidizing air for the first quantity of fluidizable microspheres to be controlled separately from a flow of fluidizing air for the second quantity of fluidizable microspheres.

9. The patient treatment bed as set forth in claim 6 further comprising means for pulsating the flow of air relative to the second flow of air.

10. A therapeutic patient treatment bed having an inflatable patient support, wherein said inflatable patient support comprises:

a platform;

a mass of fluidizable solid medium;

one or more inflatable air cushions mounted on the platform suspending the mass of fluidizable solid medium above the platform and restricting the mass of fluidizable solid medium from contacting the platform; and one or more air pressure supplies to inflate the one or more air cushions and to fluidize the mass of fluidizable solid medium so as to enable deformation of said patient support.

11. The therapeutic patient treatment bed of claim 10, further comprising means for fluidizing the fluidizable solid medium.

12. The therapeutic patient treatment bed of claim 10, wherein inflation of the one or more air cushions is operable to fluidize the fluidizable solid medium.

13. The therapeutic patient treatment bed of claim 10, wherein the bed comprises at least two air pressure supplies;

a first air pressure supply of which serves to inflate at least one of the air cushions; and a second air pressure supply of which serves to fluidize the fluidizable solid medium.

14. The therapeutic patient treatment bed of claim 10, wherein the first and second air pressure supplies are independently controllable.

15. The therapeutic patient treatment bed of claim 10, further comprising:

a first inflation zone and a second inflation zone, each of which comprises one or more inflatable air cushions suspending the mass of fluidizable solid medium above the platform; and a first air pressure supply to one or more of the air cushions in the first inflation zone; and a second air pressure supply to one or more of the air cushions in the second inflation zone, wherein the first and second air pressure supplies are independently controllable.

16. The therapeutic patient treatment bed of claim 15, further comprising rotation means for rotating a patient supported by the mass of fluidizable solid medium from side to side.

17. The therapeutic patient treatment bed of claim 10, further comprising percussion means for percussing the air pressure in one or more of the air cushions.

18. The therapeutic patient treatment bed of claim 10, further comprising pulsation means for pulsating the air pressure in one or more of the air cushions.

19. The therapeutic patient treatment bed of claim 10, wherein the one or more of the air cushions includes an air permeable layer, wherein air passing from the air cushion through the air permeable layer serves to fluidize a portion of the mass of fluidizable solid medium.

20. The therapeutic patient treatment bed of claim 10, wherein at least one of the one or more of the air cushions includes an upper chamber and a lower chamber separated by an air-permeable layer, the upper chamber containing a portion of the mass of fluidizable solid medium; and the lower chamber serving as a plenum to fluidize the portion of the mass of the fluidizable solid medium in the upper chamber.

* * * * *